US009639035B2

(12) United States Patent
Hazeyama

(10) Patent No.: US 9,639,035 B2
(45) Date of Patent: May 2, 2017

(54) FIXING DEVICE HAVING RESIN FRAME SUPPORTING PRESSURE ROLLER

(71) Applicant: Brother Kogyo Kabushiki Kaisha, Nagoya-shi, Aichi-ken (JP)

(72) Inventor: Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/076,724

(22) Filed: Mar. 22, 2016

(65) Prior Publication Data

US 2016/0357132 A1 Dec. 8, 2016

(30) Foreign Application Priority Data

Jun. 4, 2015 (JP) ..... 2015-114192

(51) Int. Cl.
*G03G 15/20* (2006.01)

(52) U.S. Cl.
CPC ..... *G03G 15/2017* (2013.01)

(58) Field of Classification Search
CPC ..... G03G 15/2017
USPC ..... 399/329, 331
See application file for complete search history.

(56) References Cited

U.S. PATENT DOCUMENTS 5,404,214 A 4/1995 Yoshimoto et al.
5,442,423 A * 8/1995 Edmunds et al. . G03G 15/0822 399/256
2015/0093159 A1 4/2015 Matsuno

FOREIGN PATENT DOCUMENTS

JP H06-202509 A 7/1994
JP 2001-290386 A 10/2001
JP 2009-237033 A 10/2009
JP 2011-059359 A 3/2011
JP 2015-068907 A 4/2015

* cited by examiner

*Primary Examiner* — William J Royer
(74) *Attorney, Agent, or Firm* — Banner & Witcoff, Ltd.

(57) ABSTRACT

A fixing device includes a heat unit, a pressure roller configured to nip a conveyed sheet in cooperation with the heat unit, the pressure roller having a shaft defining an axial direction, a bearing configured to support the shaft, a frame configured to support the bearing and made from resin, and a heatsink made from metal, and in surface contact with the frame and at least one of the shaft and the bearing.

10 Claims, 6 Drawing Sheets

FIXING DEVICE HAVING RESIN FRAME SUPPORTING PRESSURE ROLLER

CROSS REFERENCE TO RELATED APPLICATION

This application claims priority from Japanese Patent Application No. 2015-114192 filed Jun. 4, 2015. The entire content of the priority application is incorporated herein by reference.

TECHNICAL FIELD

The present disclosure relates to a fixing device including a resin frame supporting a pressure roller.

BACKGROUND

Japanese Patent Application publication No. 2015-068907 discloses a fixing device provided in an image forming device. The fixing device includes a heat unit, a pressure roller for nipping a conveyed sheet in cooperation with the heat unit, and a frame supporting the pressure roller. The heat unit is urged toward the pressure roller to provide a pressure contact therebetween. The pressure roller is supported to the frame made from resin through a bearing.

SUMMARY

According to the disclosed structure, heat transmitted to the pressure roller is transmitted to the frame through the bearing. Thus, the portion of the frame near the bearing becomes high temperature to generate a steep temperature gradient in the frame. The temperature gradient is generated in the printing operation, and the temperature gradient disappears in non-printing operation during which the frame is cooled. In the fixing device, as a result of repetition of such two states, creep deformation may occur in the frame when force is applied from the pressure roller to the frame.

It is therefore an object of the present disclosure to provide a fixing device capable of restraining deformation of the frame.

According to one aspect, a fixing device includes a heat unit, a pressure roller configured to nip a conveyed sheet in cooperation with the heat unit, the pressure roller having a shaft defining an axial direction, a bearing configured to support the shaft, a frame configured to support the bearing and made from resin, and a heatsink made from metal, and in surface contact with the frame and at least one of the shaft and the bearing.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A fixing device 100 according to an embodiment will be described while referring to FIGS. 1 through 5B. First a laser printer 1 as an example of an image forming device provided with the fixing device 100 will be described. Then, details of the fixing device 100 will next be described.

Figure 1:
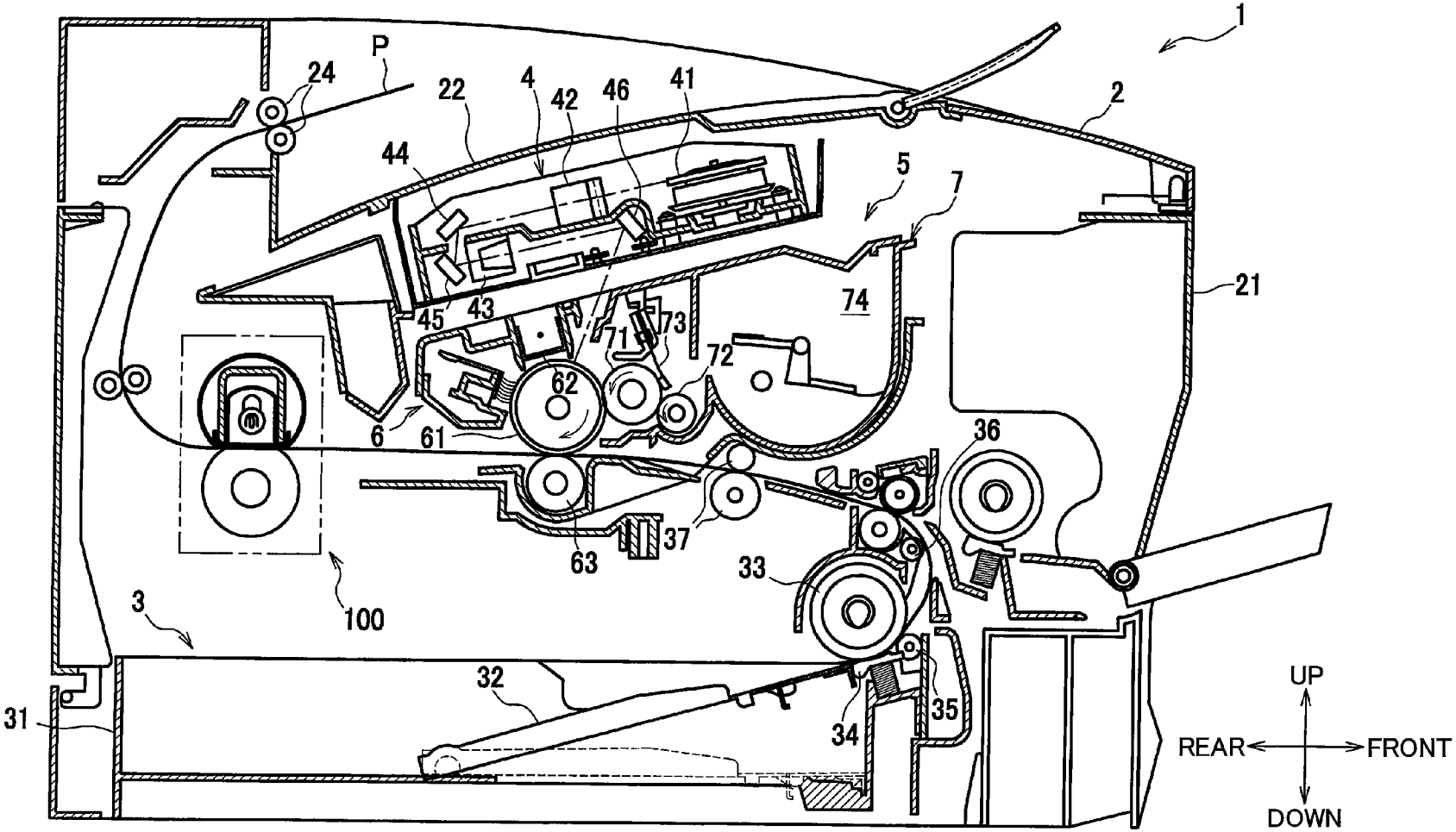
FIG. 1 is a schematic cross-sectional view of a laser printer provided with a fixing device according to an embodiment.

As shown in FIG. 1, the laser printer 1 includes a main housing 2. Within the main housing 2, primarily provided are a sheet supply unit 3 for supplying a sheet P, an exposure unit 4, a process cartridge 5 for forming a toner image on the sheet P, and the fixing device 100 for thermally fixing the toner image to the sheet P.

Directions in the following description will be based on an orientation of the laser printer 1 shown in FIG. 1. Specifically, the right side of the laser printer 1 in FIG. 1 will be referred to as "front," the left side will be referred to as "rear," the near side will be referred to as "left," the far side will be referred to as "right," the upper side will be referred to as "up," and the lower side will be referred to as "down."

The sheet supply unit 3 is positioned in a lower portion of the main housing 2, and includes a sheet supply tray 31, a lifter plate 32 for lifting up a leading end portion of the sheet P, a sheet supply roller 33, a sheet supply pad 34, a paper dust removing rollers 35, 36, and registration rollers 37. The sheet P in the sheet supply tray 31 is moved toward the sheet supply roller 33 by the lifter plate 32, and each one of the sheets P is separated from remaining sheets by the sheet supply roller 33 and the sheet supply pad 34, and is conveyed toward the process cartridge 5 by way of the paper dust removing rollers 35, 36 and the registration rollers 37.

The exposure unit 4 is provided in an upper portion of the main housing 2. The exposure unit 4 includes a laser light-emitting unit (not shown), a polygon mirror 41 rotationally driven, lenses 42, 43, and reflecting mirrors 44, 45, 46. As indicated by a dotted chain line in FIG. 1, the exposure unit 4 is configured to scanningly irradiate laser beams from the laser light emitting unit to a surface of a photosensitive drum 61 (described later) through the order of the polygon mirror 41, the lens 42, the reflecting mirrors 44, 45, the lens 43, and the reflecting mirror 46.

The process cartridge 5 is positioned below the exposure unit 4. The main housing 2 has an opening which is opened or closed by a front cover 21. The process cartridge 5 can be attached to and detached from the main housing 2 through the opening when the front cover 21 is open. The process cartridge 5 includes a drum unit 6 and a developing unit 7.

The drum unit 6 includes the photosensitive drum 61, a charger 62, and a transfer roller 63. The developing unit 7 is configured to be attached to and detached from the drum unit 6, and includes a developing roller 71, a supply roller 72, a layer thickness regulation blade 73, and a toner chamber 74 for accommodating toner therein.

In the process cartridge 5, the charger 62 performs discharge to apply a uniform charge to the surface of the photosensitive drum 61, after which the exposure unit 4 irradiates laser beams to expose the surface of photosensitive drum 61 to light for forming an electrostatic latent image thereon on a basis of image data. Further, the toner in the toner chamber 74 is supplied to the developing roller 71 via the supply roller 72. Toner on the developing roller 71 is subjected to toner layer thickness regulation by the layer thickness regulation blade 73, and such toner layer is carried on the developing roller 71.

The toner carried on the developing roller 71 is then supplied to the electrostatic latent image formed on the surface of the photosensitive drum 61 to produce a toner image on the photosensitive drum 61. Then, the toner image on the photosensitive drum 61 is transferred to the sheet P when the sheet P is moved past the photosensitive drum 61 and the transfer roller 63.

The fixing device 100 is disposed rearward of the process cartridge 5. The toner image that has been transferred onto the sheet P is thermally fixed to the sheet P when the sheet P is moved past the fixing device 100. The sheet P is then discharged on to a discharge tray 22 by conveyer rollers 24.

Figure 2:
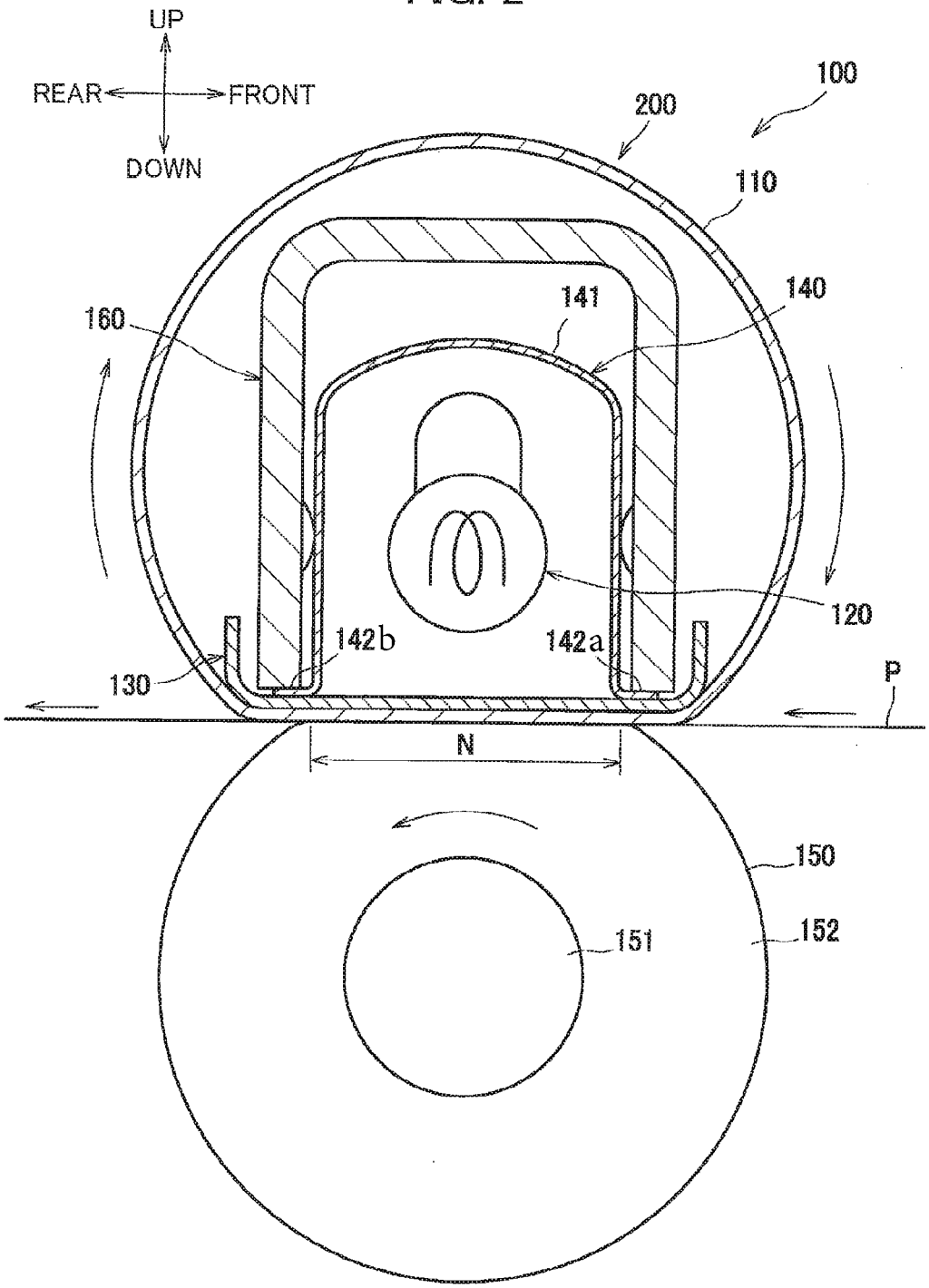
FIG. 2 is a cross-sectional view illustrating the fixing device according to the embodiment.

As shown in FIG. 2, the fixing device 100 includes a heat unit 200 and a pressure roller 150 for nipping a sheet P conveyed frontward in cooperation with the heat unit 200.

The heat unit 200 includes a fixing belt 110, a halogen lamp 120, a nip plate 130, a reflection plate 140, and a stay 160 those provided in an internal space of the fixing belt 110.

The fixing belt 110 is a tubular film member extending in leftward/rightward direction, and providing heat resistivity and flexibility. The fixing belt 110 has a left end portion and a right end portion each being guided by each guide member 170 (FIG. 4, described later) so that the fixing belt 110 is circularly movable.

The halogen lamp 120 is disposed in the internal space of the fixing belt 110 and is spaced apart at a prescribed distance from inner surfaces of the fixing belt 110 and the nip plate 130. The halogen lamp 120 is a heater configured to heat the nip plate 130 and the fixing belt 110 to heat toner carried on the sheet P.

The nip plate 130 is a plate-like member and is configured to receive radiant heat from the halogen lamp 120. The nip plate 130 is disposed in the internal space of the fixing belt 110, and has a surface in relative sliding contact with an inner circumferential surface of the fixing belt 110. The nip plate 130 is configured to receive radiant heat from the halogen lamp 120 and to transmit the heat to the toner carried on the sheet P through the fixing belt 110. The nip plate 130 is made from metal such as aluminum having heat conductivity higher than that of the stay 160.

The reflection plate 140 is configured to reflect radiant heat from the halogen lamp 120 toward the nip plate 130. The reflection plate 140 is disposed to cover the halogen lamp 120 and is spaced away from the halogen lamp 120 by a predetermined distance.

The reflection plate 140 is provided by a metal plate such as an aluminum plate having a high reflection ratio with respect to infrared ray and far infrared ray. The reflection plate 140 is shaped into U-shape in cross-section by bending the metal plate. More specifically, the reflection plate 140 is constituted by a reflection portion 141 having generally U shape in cross-section, a front flange portion 142*a* extending frontward from a lower front end portion of the reflection portion 141 and a rear flange portion 142*b* extending rearward from a lower rear end portion of the reflection portion 141.

The pressure roller 150 is disposed below the heat unit 200. The pressure roller 150 includes a shaft portion 151 extending in leftward/rightward direction, and a roller body 152 disposed over the shaft portion 151 and rotated about an axis of the shaft portion 151 along with the shaft portion 151. The roller body 152 is resiliently deformable. Upon resilient deformation of the roller body 152, the pressure roller 150 nips the fixing belt 110 in cooperation with the nip plate 130 thereby forming a nip region N with respect to the fixing belt 110.

A motor (not shown) is provided in the main housing 2 for rotationally driving the pressure roller 150. Rotation of the pressure roller 150 causes circular movement of the fixing belt 110 through frictional force with the surface of fixing belt 110 or via the sheet P.

Thus, the toner image carried on the sheet P is thermally fixed to the sheet P when the sheet P is conveyed between the pressure roller 150 and the heated fixing belt 110.

The stay 160 is adapted to support a front end portion and a rear end portion of the nip plate 130 via the front and rear flange portions 142*a*, 142*b* of the reflection plate 140 to ensure rigidity of the nip plate 130. The stay 160 is U-shaped in conformance with an outer shape of the reflection portion 141 of the reflection plate 140 for covering the reflection plate 140. The stay 160 has a rigidity higher than that of the reflection plate 140. For example, the stay 160 is formed of a metal plate bent into U-shape.

Figure 3:
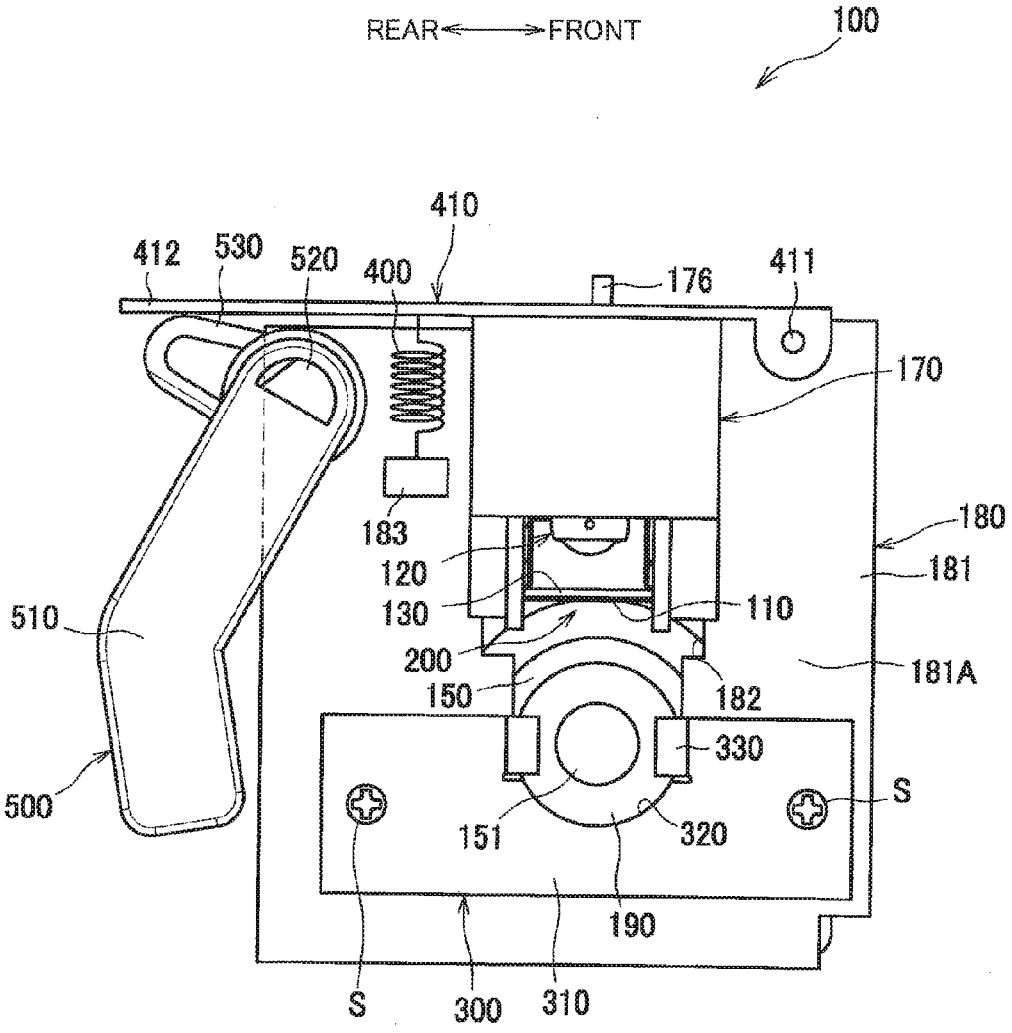
FIG. 3 is a left side view of the fixing device according to the embodiment.

As shown in FIG. 3, the fixing device 100 includes a bearing 190 supporting the pressure roller 150, a frame 180 supporting the bearing 190, and the guide member 170 supporting the heat unit 200. Incidentally, the fixing device 100 is bilaterally symmetric except for a power transmission gear arrangement that transmits driving force from the motor provided in the main housing 2. Therefore, FIGS. 3 through 6 show a left end portion of the fixing device 100, while a right end portion thereof is not shown.

Figure 4:
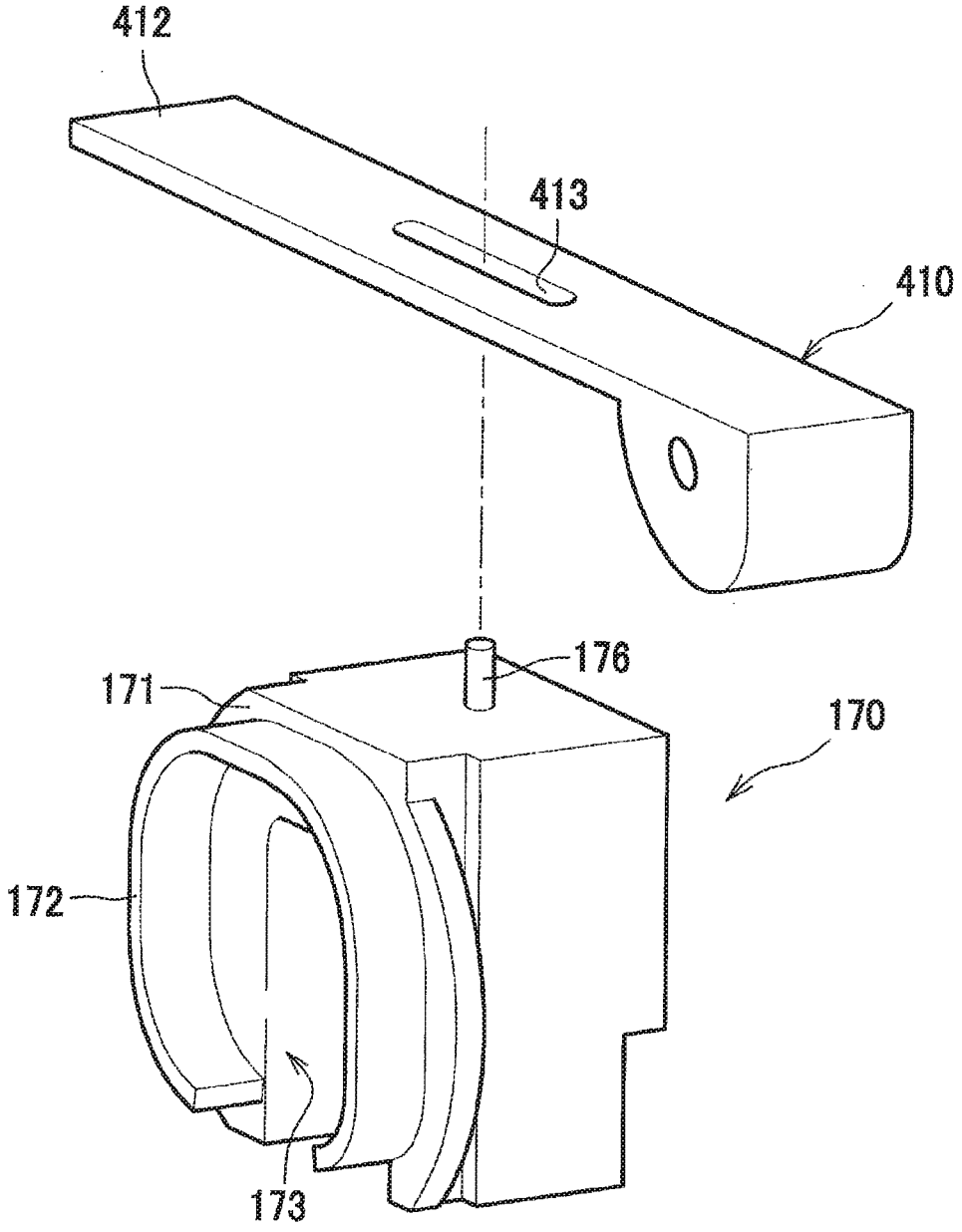
FIG. 4 is an exploded perspective view of a pivot arm and a guide member in the fixing device according to the embodiment.

The guide member 170 is made from an electrically insulating material such as resin. Further, each one guide member 170 is provided at each end of the fixing belt 110 for regulating position of a lateral end face of the fixing belt 110. More specifically, as shown in FIG. 4, the guide member 170 includes a regulation surface 171 for regulating displacement of the fixing belt 110 in leftward/rightward direction (lateral direction), a restricting portion 172 for restricting radially inward deformation of the fixing belt 110, and a recessed portion 173 for retaining a lateral end portion of the stay 160.

The restricting portion 172 is a rib protruding inward in leftward/rightward direction from the regulation surface 171, and is C-shaped opening downward. The restricting portion 172 is inserted into the fixing belt 110 for restricting radially inward deformation of the fixing belt 110.

The recessed portion 173 is a groove like configuration opening downward and is also open inward in leftward/rightward direction. The lateral end portion of the stay 160 is fitted within the recessed portion 173 while the stay 160 presses against the nip plate 130 and the reflection plate 140. Thus, the stay 160 is supported to the guide member 170.

The frame 180 is made from resin and has side walls 181.

Each side wall 181 has a side surface 181A extending in a direction perpendicular to an axial direction of the pressure roller 150, i.e., leftward/rightward direction. The side surface 181A faces outward in the leftward/rightward direction. The side wall 181 is formed with a support groove 182 extending in vertical direction for guiding vertical movement of the guide member 170. The guide groove 182 has an upper open end. The side wall 181 is provided with the bearing 190, a coil spring 400 as an example of an urging member, a pivot arm 410 as an example of a second frame, a switching member 500, and a heatsink 300.

Figure 5A:
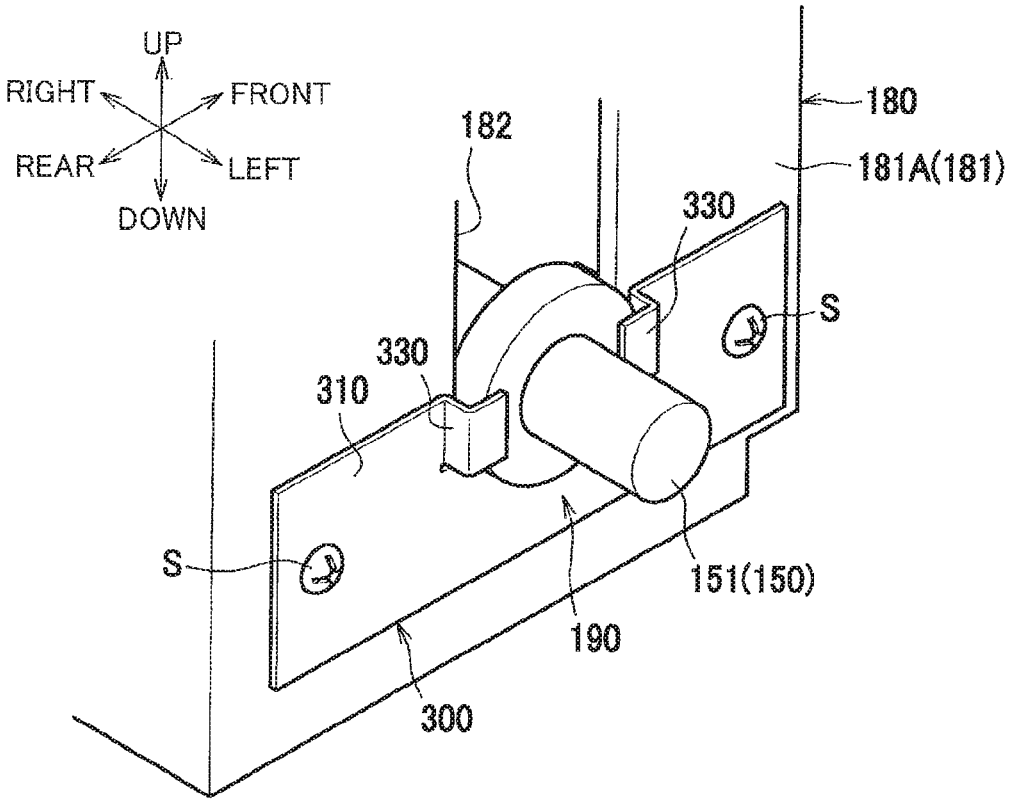
FIG. 5A is a partial enlarged perspective view particularly illustrating a heatsink in the fixing device according to the embodiment.

The bearing 190 is an antifriction bearing made from metal such as a roller bearing. As shown in FIG. 5A, the bearing 190 has an annular configuration through which the shaft portion 151 of the pressure roller 150 extends. The bearing 190 is received in and engaged with a lower end portion of the support groove 182 of the frame 180.

As shown in FIG. 3, the pivot arm 410 extends from a front end portion of the side wall 181. The pivot arm 410 is elongated in the frontward/rearward direction, and has a front end portion supported to a pivot shaft 411, so that the pivot arm 410 is pivotally movable relative to the frame 180 about an axis of the pivot shaft 411. The pivot arm 410 has a rear end portion 412, and an intermediate portion positioned between the front end portion and the rear end portion 412. The intermediate portion supports the guide member 170. That is, the pivot arm 410 supports the heat unit 200.

More specifically, as shown in FIG. 4, the intermediate portion of the pivot arm 410 is formed with a slot 413 extending in the elongated direction of the pivot arm 410. On the other hand, a protrusion 176 protrudes upward from a top surface of the guide member 170. The protrusion 176 extends through the slot 413, so that the guide member 170 is supported to the pivot arm 410.

In FIG. 3, the coil spring 400 is adapted to urge the pivot arm 410 toward the frame 180, so that the heat unit 200 is urged toward the pressure roller 150 by way of the pivot arm 410. More specifically, a spring support 183 protrudes outward from the side wall 181 in leftward/rightward direction at a position rearward of the guide member 170. One end of the coil spring 400 is fixed to the spring support 183. Another end of the coil spring 400 is fixed to the pivot arm 410 at a position rearward of the guide member 170. The rear end portion 412 of the pivot arm 410 is spaced away from the frame 180 but is urged downward.

The switching member 500 is adapted to release pressure contact between the heat unit 200 and the pressure roller 150 by acting on the pivot arm 410 upon pivotal movement of the switching member 500. More specifically, the switching member 500 includes an operation lever 510, a pivot shaft 520, and a cam portion 530.

The operation lever 510 has one end portion from which the pivot shaft 520 protrudes integrally. The pivot shaft 520 is supported to the side wall 181. Thus, the operation lever 510 is pivotally movable about an axis of the pivot shaft 520.

The cam portion 530 integrally extends radially outwardly from the pivot shaft 520, so that the cam portion 530 is pivotally movable along with the pivotal movement of the operation lever 510. By pivotally moving the operation lever 510 in clockwise direction in FIG. 3, the cam portion 530 urges the pivot arm 410 upward against the urging force of the coil spring 400. As a result, the nip plate 130 is moved away from the pressure roller 150 to release the nip pressure. On the other hand, by pivotally moving the operation lever 510 in counterclockwise direction in FIG. 3, the cam portion 530 is moved away from the pivot arm 410, so that the guide member 170 is moved downward by the urging force of the coil spring 400. As a result, the nip plate 130 is brought into pressure contact with the pressure roller 150 through the fixing belt 110.

The heatsink 300 is formed of a metal plate such as an aluminum plate. Here, the term aluminum implies pure aluminum as well as an aluminum alloy. The heatsink 300 is fixed to the side wall 181 of the frame 180 so as to be in surface contact with the side surface 181A of the frame 180 and a surface of the bearing 190.

Figure 5B:
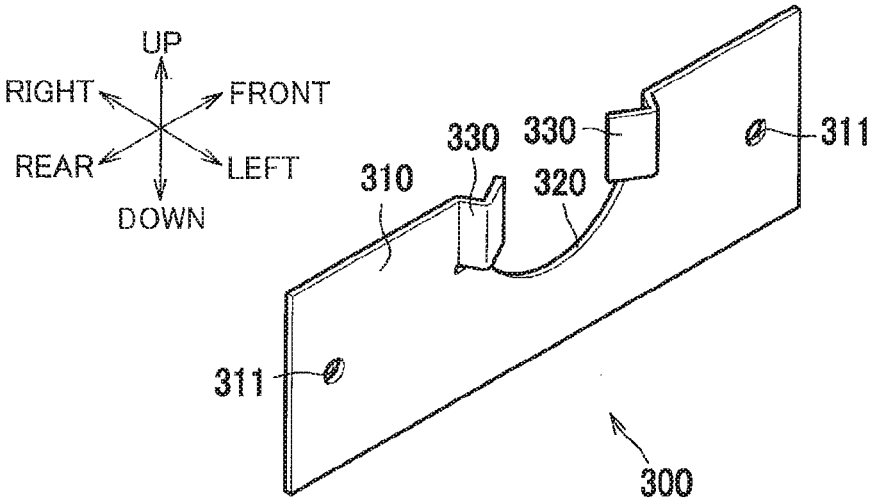
FIG. 5B is a perspective view of the heatsink in the fixing device according to the embodiment.

More specifically, as shown in FIGS. 5A and 5B, the heatsink 300 includes a flat plate portion 310 extending in a direction perpendicular to the axial direction of the pressure roller 150, i.e., perpendicular to leftward/rightward direction, and also extends in frontward/rearward direction along the side wall 181. As shown in FIG. 5B, an intermediate portion of the flat plate portion 310 in frontward/rearward direction is formed with a notched portion 320 providing a semicircular notch recessed downward from a top end of the flat plate portion 310. Further, a pair of contact portions 330 is provided in the heatsink 300. Each contact portion 330 extends outward in leftward/rightward direction from an upper end portion of the flat plate portion 310 and from a position outward of the notched portion 320 in frontward/rearward direction. Further, each contact portion 330 is bent to extend to a position inward of the notched portion 320 in frontward/rearward direction. The flat plate portion 310 has end portions in frontward/rearward direction, and a through-hole 311 is formed in each end portion.

As shown in FIG. 5A, the heatsink 300 is positioned on the side surface 181A of the frame 180 such that the bearing 190 is positioned inward of the contact portions 330 of the heatsink 300 in leftward/rightward direction. A male thread S as an example of a fastener extends through each through-hole 311 and is threadingly engaged with the side wall 181. Thus, the heatsink 300 is fixed to the frame 180. That is, the flat plate portion 310 of the heatsink 300 is fixed to the side surface 181A.

Accordingly, the flat plate portion 310 is in surface contact with the side surface 181A, and the contact portions 330 are in contact with a front end surface, a rear end surface and laterally outer surface of the bearing 190. Here the term "laterally" implies leftward/rightward direction. Further, an end face of the notched portion 320 is in contact with an outer peripheral surface of the bearing 190.

As shown in FIG. 3, the heatsink 300 is in surface contact with the frame 180 at positions frontward, downward, and rearward of the bearing 190.

More specifically, the heatsink 300 is in surface contact with the side surface 181A at regions upstream and downstream of the shaft portion 151 of the pressure roller 150 in a sheet conveying direction, i.e., at a front region and a rear region of the side surface 181A. Further, the heatsink 300 is in surface contact with the side surface 181A at regions frontward and rearward of the nip region N (FIG. 2) formed between the heat unit 200 and the pressure roller 150.

The front end portion of the heatsink 300 is positioned frontward of the pivot shaft 411 of the pivot arm 410. That is, the heatsink 300 is in contact with the side surface 181A at regions frontward and rearward of the pivot shaft 411.

Further, the rear end portion of the heatsink 300 is positioned rearward of a portion where the coil spring 400 acts on the frame 180, i.e., rearward of the spring support 183. In other words, the heatsink 300 is in contact with the side surface 181A at regions frontward and rearward of the spring support 183.

Next, advantages obtained by the above-described fixing device 100 will be described. Temperature of the heat unit 200 is elevated upon start of the image forming operation. In this case, temperature of the pressure roller 150 is also elevated because of heat transfer from the heat unit 200, and the heat from the pressure roller 150 is transmitted to the frame 180 through the bearing 190.

If the heatsink 300 were not provided, a temperature of a portion of the frame 180 positioned adjacent to the bearing 190 becomes higher than a remaining portion of the frame 180, so that steep temperature gradient is generated in the frame 180. In the fixing device 100, are repeated a state where the temperature gradient is generated in the frame 180 due to printing operation and another state where the temperature gradient disappears due to cooling to the frame 180 as a result of termination of printing operation. By such repetition, creep deformation may occur in the frame 180 due to pressure applied from the pressure roller 150 and biasing force from the coil spring 400. More specifically, vertical displacement of the guide member 170 in frontward/rearward direction may be degraded or restrained if a width of the support groove 182 is increased or decreased due to creep deformation of the frame 180.

According to the present embodiment, heat transmitted from the bearing 190 to the pressure roller 150 can be diffused to a wider region of the frame 180 by the heatsink 300. Therefore, temperature gradient generated in the frame 180 can be moderated in comparison with a case where the heatsink 300 is not provided. Further, heat dissipation efficiency of the heatsink 300 is higher than that of the frame 190 because the heatsink 300 is made from metal whereas the frame 190 is made from resin. Accordingly, generation of steep temperature gradient in the frame 180 can be restrained, which can restrain creep deformation of the frame 180.

In the present embodiment, the heatsink 300 is in surface contact with the side surface 181A of the frame 180. Therefore, an enlarged contact area between the frame 180 and the heatsink 300 can be obtained, and heat transmission to a wider region of the frame 180 can be achieved. Further, the heatsink 300 is made from aluminum, whose thermal conductivity is higher than iron which is a construction material of the laser printer 1.

Further, the heatsink 300 is fixed to the side surface 181A of the frame 180, which can reinforce the side wall 181 of the frame 180.

Particularly, in the present embodiment, the heatsink 300 is in surface contact with the front region of the side surface 181A frontward of the pivot shaft 411 of the pivot arm 410, and the rear region of the side surface rearward of the pivot shaft 411 of the pivot arm 410. With this structure, a portion of the frame 180 to which urging force from the pivot arm 410 is applied can be reinforced by the heatsink 300.

Further, the heatsink 300 is in surface contact with the front region of the side surface 181A frontward of the spring support 183 and the rear region of the side surface rearward of the spring support 183. With this structure a portion of the frame 180 to which urging force from the coil spring 400 is applied can be reinforced by the heatsink 300.

Further, the flat plate portion 310 of the heatsink 300 in surface contact with the side surface 181A extends in a direction perpendicular to the axial direction of the pressure roller 150. Because the flat plate portion 310 has high bending rigidity, deformation of the frame 180 can be restrained by the flat plate portion 310 against urging force applied to the frame 180 from the pressure roller 150 through the bearing 190 and from the coil spring 400.

Further, the heatsink 300 is solidly fixed to the frame 180, because the heatsink 300 is fixed to the frame 180 by the male threads S. Thus, heat transfer from the frame 180 to the heatsink 300 and mechanical reinforcement to the frame 180 can be ensured.

Various modifications may be conceivable. In the above-described embodiment, the bearing 190 of the pressure roller 150 is in contact with the heatsink 300. However, the shaft portion 151 of the pressure roller 150 can be in contact with the heatsink 300. For example, a contact portion 330 of the heatsink 300 can be in contact with the shaft portion 151.

Figure 6:
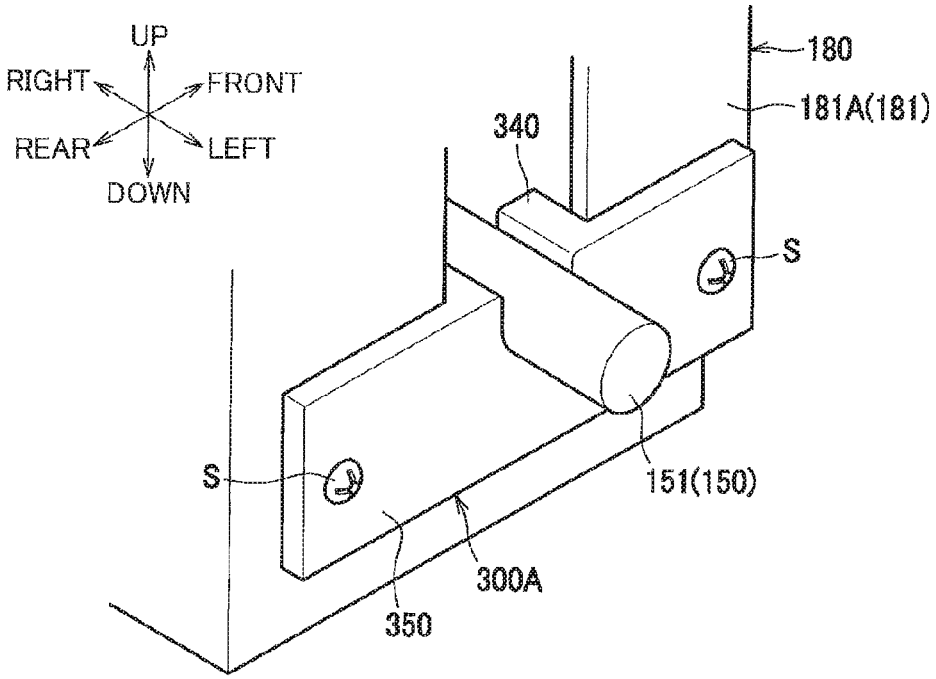
FIG. 6 is a perspective view of a heatsink according to a first modification.

In the above-described embodiment, the bearing 190 of the pressure roller 150 is a component different from the heatsink 300. However, as shown in FIG. 6, a heatsink 300A is integral with a bearing portion 340. In other words, a bearing member 300A (or the heatsink 300A) includes a flat plate portion 350 and the bearing portion 340.

More specifically, the heatsink 300A is made from metal, and includes the bearing portion 340 which is a sliding bearing having a U-shape cross-section, and the flat plate portion 350 in surface contact with the side surface 181A of the frame 180 and extending outwardly in radial direction of the shaft portion 151. Front and rear end portions of the flat plate portion 350 are fixed to the frame 180 by male threads S to be in surface contact with the side surface 181A.

Because the flat plate portion 350 is integral with the bearing portion 340, the heatsink 300A is in contact with the shaft portion 151, so that the heat of the shaft portion 151 can be effectively transmitted to the heatsink 300A.

Figure 7:
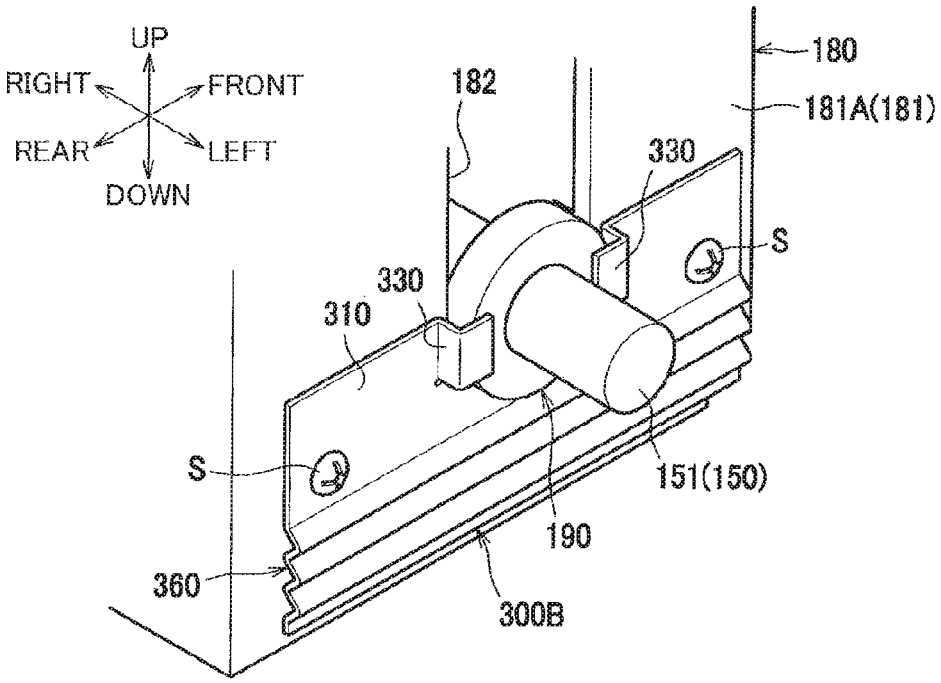
FIG. 7 is a perspective view of a heatsink according to a second modification.

Further, as shown in FIG. 7, a heatsink 300B can include a heat radiation portion 360 which is not in surface contact with the frame 180. That is, the heatsink 300B includes a flat plate portion 310 and the heat radiation portion 360 positioned below and integrally with the flat plate portion 310 in bellows form. Because of the bellows form, a surface area of the heatsink 300B can be increased to enhance heat radiation to an ambient air.

In the above-described embodiment, the heatsink 300 is in surface contact with the side surface 181A of the frame 180. However, the contacting region is not limited to this embodiment. For example, the heatsink 300 can be in surface contact with at least one of a lower surface, a rear surface, and a front surface of the frame 180 instead of the side surface 181A.

In the above-described embodiment, the heat unit 200 includes the fixing belt 110 and the nip plate 130. However, another structure is available. For example, a heat unit can be provided by a heat roller and a halogen heater provided in an internal space of the heat roller.

While the description has been made in detail with reference to specific embodiment(s) thereof, it would be apparent to those skilled in the art that various changes and modifications may be made therein without departing from the spirit and scope of the above described embodiment(s).

What is claimed is:

1. A fixing device comprising:

a heat unit:

a pressure roller configured to nip a conveyed sheet in cooperation with the heat unit, the pressure roller having a shaft defining an axial direction;

a bearing configured to support the shaft;

a resin frame configured to support the bearing; and a metal heatsink in surface contact with the frame and at least one of the shaft and the bearing.

2. The fixing device according to claim 1, wherein the frame has a side surface extending in a direction perpendicular to the axial direction; and wherein the heatsink has a flat plate portion extending in a direction perpendicular to the axial direction and in surface contact with the side surface.

3. The fixing device according to claim 2, wherein the heatsink has an upstream region in surface contact with the side surface and positioned upstream of the shaft in a sheet conveying direction and a downstream region in surface contact with the side surface and positioned downstream of the shaft in the sheet conveying direction.

4. The fixing device according to claim 2, further comprising a fastener configured to fix the heatsink to the side surface of the frame.

5. The fixing device according to claim 4, further comprising:

a second frame configured to support the heat unit; and a pivot shaft configured to connect the frame to the second frame such that one of the frame and the second frame is pivotally movable relative to remaining one of the frame and the second frame about an axis of the pivot shaft, the heatsink having an upstream area in surface contact with the side surface and positioned upstream of the pivot shaft in a sheet conveying direction, and a downstream region in surface contact with the side surface and positioned downstream of the pivot shaft in the sheet conveying direction.

6. The fixing device according to claim 5, further comprising an urging member urging one of the frame and the second frame toward remaining one of the frame and the second frame, the frame having a force-applied portion against which urging force of the urging member is applied, the heatsink having an upstream portion in surface contact with the side surface and positioned upstream of the force-applied portion in a sheet conveying direction, and a downstream portion in surface contact with the side surface and positioned downstream of the force-applied portion in the sheet conveying direction.

7. The fixing device according to claim 4, wherein the fastener is a male thread.

8. The fixing device according to claim 1, wherein the heatsink is made from aluminum.

9. The fixing device according to claim 1, wherein the bearing is made from metal.

10. The fixing device according to claim 1, wherein the heatsink is integral with the bearing.

* * * * *